US011205875B2

(12) United States Patent
Wolf

(10) Patent No.: US 11,205,875 B2
(45) Date of Patent: Dec. 21, 2021

(54) PLUG CONNECTOR COMPRISING POLARISATION ELEMENT, AND SYSTEM AND METHOD FOR MOUNTING, FOR PLUGGING, AND FOR SEPARATING SAID PLUG CONNECTOR

(71) Applicant: HARTING ELECTRONICS GMBH, Espelkamp (DE)

(72) Inventor: Torsten Wolf, Luebbecke (DE)

(73) Assignee: HARTING ELECTRONICS GMBH

( * ) Notice: Subject to any disclaimer, the term of this patent is extended or adjusted under 35 U.S.C. 154(b) by 0 days.

(21) Appl. No.: 16/960,303

(22) PCT Filed: Feb. 21, 2019

(86) PCT No.: PCT/DE2019/100164
§ 371 (c)(1),
(2) Date: Jul. 6, 2020

(87) PCT Pub. No.: WO2019/161848
PCT Pub. Date: Aug. 29, 2019

(65) Prior Publication Data

US 2021/0057850 A1 Feb. 25, 2021

(30) Foreign Application Priority Data

Feb. 22, 2018 (DE) ..... 10 2018 104 017.2

(51) Int. Cl.
*H01R 13/627* (2006.01)
*H01R 13/633* (2006.01)
(Continued)

(52) U.S. Cl.
CPC ..... *H01R 13/633* (2013.01); *H01R 13/645* (2013.01); *H01R 43/20* (2013.01); *H01R 43/26* (2013.01)

(58) Field of Classification Search
CPC ... H01R 13/633; H01R 13/6445; H01R 43/20
See application file for complete search history.

(56) References Cited

U.S. PATENT DOCUMENTS 6,250,942 B1 * 6/2001 Lemke ..... H01R 13/6272 439/352
6,709,289 B2 3/2004 Huber et al. ..... 439/578
(Continued)

FOREIGN PATENT DOCUMENTS

CN 201117962 9/2008 ..... H01R 13/64
CN 201549726 8/2010 ..... H01R 13/502
(Continued)

OTHER PUBLICATIONS

German Search Report issued in German Patent Appln. No. 10 2018 104 017.2 dated Oct. 18, 2018, with English translation, 11 pages.
(Continued)

*Primary Examiner* — Neil Abrams
(74) *Attorney, Agent, or Firm* — Hayes Soloway P.C.

(57) ABSTRACT

Disclosed is a plug connector which can be latched to a mating plug connector having a plug connector housing having a plurality of sides each having a flat shape, a plug connector insert which is fixed or at least can be fixed in the plug connector housing, and an unlocking sleeve which engages around the plug connector housing and is held thereon so as to be displaceable counter to the plugging direction. At least one polarization element is mounted on a side of the unlocking sleeve. Also disclosed is a system, a method for mounting, a method for plugging, and a method for separating plug connectors and mating plug connectors.

17 Claims, 3 Drawing Sheets

(51) Int. Cl.

| | |
|---|---|
| ***H01R 13/645*** | (2006.01) |
| ***H01R 43/20*** | (2006.01) |
| ***H01R 43/26*** | (2006.01) |

(56) References Cited

U.S. PATENT DOCUMENTS

| | | | | |
|---|---|---|---|---|
| 6,863,556 | B2 * | 3/2005 | Viklund | H01R 13/6272 439/354 |
| 6,918,782 | B2 * | 7/2005 | Foster | H01R 13/6272 439/301 |
| 7,238,047 | B2 * | 7/2007 | Saettele | H01R 13/627 439/253 |
| 7,335,047 | B2 | 2/2008 | Bernat et al. | 439/350 |
| 7,484,988 | B2 * | 2/2009 | Ma | H01R 13/502 439/350 |
| 7,549,887 | B1 | 6/2009 | Ng et al. | 439/352 |
| 7,758,370 | B1 * | 7/2010 | Flaherty | H01R 24/50 439/352 |
| 7,824,207 | B2 * | 11/2010 | Bergner | H01R 13/6271 439/352 |
| 7,892,004 | B2 * | 2/2011 | Hertzler | H01R 13/6277 439/312 |
| 8,496,495 | B2 * | 7/2013 | Kari | H01R 13/6277 439/352 |
| 10,978,830 | B2 * | 4/2021 | Hammerling | H01R 13/6271 |
| 2002/0173197 | A1 | 11/2002 | Endo | 439/489 |
| 2007/0275589 | A1 | 11/2007 | Ohtaka et al. | 439/354 |
| 2008/0200073 | A1 | 8/2008 | Mermaz et al. | 439/682 |
| 2011/0091159 | A1 | 4/2011 | De Jong et al. | 385/72 |
| 2021/0057850 | A1 * | 2/2021 | Wolf | H01R 13/645 |

FOREIGN PATENT DOCUMENTS

| | | | |
|---|---|---|---|
| CN | 104966946 | 10/2015 | H01R 13/64 |
| CN | 205051070 | 2/2016 | H01R 13/52 |
| DE | 298 23 719 | 12/1999 | H01R 13/645 |
| DE | 102 36 275 | 1/2004 | H01R 13/627 |
| DE | 10 2007 031 504 | 1/2009 | H01R 13/629 |
| DE | 10 2013 222 411 | 5/2015 | H01R 13/639 |
| EP | 1 337 008 | 1/2003 | H01R 13/646 |
| EP | 1 841 016 | 10/2007 | H01R 13/627 |
| EP | 1 959 523 | 2/2009 | H01R 13/645 |

OTHER PUBLICATIONS

International Search Report (with English translation) and Written Opinion issued in PCT/DE2019/100164, dated May 24, 2019, 12 pages.

Office Action issued in Chinese Patent Appln. Serial No. 201980014218.3, dated Mar. 24, 2021, with machine English translation, 18 pages.

International Preliminary Report on Patentabiity (with English translation) issued in PCT/DE2019/100164, dated Aug. 27, 2020, 10 pages.

* cited by examiner

PLUG CONNECTOR COMPRISING POLARISATION ELEMENT, AND SYSTEM AND METHOD FOR MOUNTING, FOR PLUGGING, AND FOR SEPARATING SAID PLUG CONNECTOR

BACKGROUND OF THE INVENTION

The invention starts with a plug connector for latching to a mating plug connector and a system comprising the plug connector and a mating plug connector, an assembly method, a mating method and a separating method of a plug connector.

Plug connectors of this type are required to enable plug connections to be conveniently locked and released.

BRIEF DESCRIPTION OF THE PRIOR ART

In the prior art, so-called "push-pull" plug connectors are well known to the person skilled in the art. The operating concept conventionally consists in drawing a sleeve of the plug connector away from the mating plug for release purposes so that both the operation of the release device and the separation of the plug from the mating plug takes place in a single movement direction and therefore with a single hand movement. The mating plug conventionally has an attachment housing and can be attached to a housing wall, for example, so this procedure can generally be executed with one hand.

Printed document EP 1 841 016 B1 discloses a metal plug connector for use in a harsh and damp industrial environment. This has a plug connector housing in a rectangular form, e.g. a die-cast zinc plug connector housing, which is encompassed by a corresponding release sleeve on the one hand and in which a plug insert is fastened on the other. The plug connector housing is provided with a release sleeve and has a locking device, which achieves an interlocking state with a mating plug during the mating procedure. When the release sleeve is drawn back, locking hooks of the locking device, which are provided for locking purposes, are lifted "outwards" out of latching recesses on the mating plug.

DE 102 36 275 B3 discloses a locking device for two mutually connectable plug connectors, wherein latching hooks on one of the plug connectors engage in latching recesses in the second plug connector as the plug connectors are connected. The latching hooks can be raised and lifted out of the latching recesses by means of an actuator, here a sliding sleeve and chamfers integrally molded thereon, enabling the plug connectors to be separated.

EP 1 337 008 A2 discloses a plug connector which has a locking ring, wherein the locking ring can be radially widened by means of a release sleeve and an interlocking state with a mating plug connector can thus be released.

EP 1 959 523 B1 discloses a coding on the mating side for the non-interchangeable mating of two plug connectors, in particular two push-pull plug connectors. The coding is retrofitted in the plug connector insert of the first plug connector and cooperates with a corresponding mating form on the plug connector insert of the second plug connector. The coding prevents the plug connector from being intermated with a mating plug connector other than the intended second plug connector.

DE 298 23 719 U1 discloses a coding device for two mutually complementary plugs, of which one is provided with at least one first coding element and the other is provided with at least one second coding element complementary thereto, wherein at least one of the plug connectors comprises a housing having an attachable coupler, wherein at least one of the coding elements is arranged on the coupler.

The known coding devices are disadvantageous in that they are only devised retrospectively for the plug connector type and are therefore often insufficiently adapted to the specific properties thereof. A further disadvantage of the prior art is furthermore that incorrect mating frequently occurs due to the wrong orientation of the plug connector, which can result in damage to the plug connector and/or even in high consequential costs.

The German Patent and Trademark Office has consulted the following prior art with regard to the present application: DE 10 2007 031 504 A1 and DE 10 2013 222 411 A1.

OBJECT OF THE INVENTION

The object of the invention consists in proposing a plug connector, in particular a push-pull plug connector, which enables a convenient, correct mating and which can be manufactured easily, cost-effectively and efficiently and which is moreover easy to handle.

BRIEF SUMMARY OF THE INVENTION

The invention relates to a plug connector, which can be latched to a mating plug connector, having

- a plug connector housing with a plurality of sides which each have a planar form,
- a plug connector insert, which is fastened, or at least can be fastened, in the plug connector housing, and
- a release sleeve, which reaches around the plug connector housing and is retained on the plug connector housing such that it can be displaced contrary to the mating direction for releasing the plug connector from the mating plug connector.

According to the invention, the release sleeve has at least one polarization element in order to cooperate with both the plug connector housing and the mating plug connector in a polarizing manner.

In particular, the release sleeve has different contours on the inside at two opposing sides in order to cooperate with the plug connector housing and the mating plug connector in a polarizing manner. In this case, the at least one polarization element can be a constituent part of at least one of these contours.

This is advantageous since, incorrect mating, i.e. mating with the wrong orientation, i.e. polarization, is thus prevented from the outset. With the correction orientation, mating is possible without any problem. Therefore, mating the plug connector to the mating plug connector is advantageously enabled with the correct polarization and prevented with the wrong polarization.

On the other hand, the different configuration of the said two mutually opposing sides of the release sleeve is particularly advantageous since incorrect assembly is also additionally prevented thereby. Finally, this also blocks the insertion of a plug connector housing with the wrong orientation into the release sleeve. Therefore, as an additional advantage, correct assembly is simplified considerably for an assembly technician.

The plug connector housing can preferably be designed to be square or rectangular in cross-section. It can preferably have four sides, in particular two wide sides and two narrow sides, which are parallel opposite one another. Accordingly, the release sleeve can also have a form matching this, which is rectangular or square in cross-section.

In particular, the release sleeve can have precisely one polarization element. The polarization element can be arranged on a side of the release sleeve, wherein this side of the release sleeve is accordingly also referred to as the coding side. The polarization element blocks the mating procedure if the plug connector is to be mated to a mating plug connector with the wrong orientation, i.e. with the wrong polarization.

The polarization element in this case is configured, in particular, such that it prevents incorrect mating, since it advantageously meets the mating plug connector first, i.e. before the plug connector insert received in the plug connector housing. Damage to the plug connector insert is thus advantageously prevented. With the correct orientation of the plug connector with respect to the mating plug connector, i.e. with the correct polarization, mating is possible without any problem. The polarization element can form the said internal contour of the coding side of the release sleeve or at least be a constituent part thereof. The contour of the opposing side can be configured differently; for example, in this case, it could be a planar contour. In particular, however, this side can also have latching and/or guide means, which is why it is also referred to below as a the guide side.

A further advantage is that the mating reliability and the assembly reliability are increased as a result of the at least one polarization element and in particular as a result of the different internal configuration of these two mutually opposing sides of the release sleeve, namely the coding side and the guide side. It is particularly advantageous in this case that, as a result, there is no transport risk with regard to the polarization element. In contrast to many known designs, the polarization element is not exposed to relevant external environmental influences. This in turn increases the useful life of the plug connector. Finally, the polarization element according to the above-mentioned design can be secured on the plug connector in a particularly stable manner.

On that side which faces the polarization element after correct assembly, the plug connector housing preferably has a corresponding mating contour with which the polarization element can cooperate for release and locking purposes. This mating contour can have, for example, at least one, in particular two, parallel-extending elevations, which, in the assembled state, are arranged on both sides of the polarization element and guide the release sleeve along its polarization element in the mating direction so that the release sleeve is retained on the plug connector housing such that can be displaced both in and contrary to the mating direction.

This contour can alternatively or additionally have a recess. In this case, the spacing between the two said elevations or the width of this recess can correspond approximately to the width of the polarization element or be somewhat greater than this, i.e. it can exceed the width of the polarization element for example by up to 4%, preferably up to 7%, particularly preferably up to 10%, in particular up to 13% and possibly even up to 16%. The release element can thus be guided along the plug connector housing, possibly with the "play", i.e. mechanical tolerance, required for this and still be fixed in terms of its polarization. This mating contour therefore serves to further increase the mating reliability and the assembly reliability since, as a result, neither assembly nor mating is possible with the wrong polarization.

At least one latching hook for latching the plug connector to the mating plug connector is arranged on the side of the plug connector housing which is opposite the polarization element after assembly. This latching hook can be arranged, for example, centrally on the release sleeve. The latching hook is advantageously arranged opposite the polarization element in order to particularly effectively prevent incorrect mating with the wrong polarization. The number of latching hooks is arbitrary, although the use of one latching hook has proven advantageous. The latching hook therefore has at least a dual function and, in particular, even a triple function. Firstly, it advantageously serves to retain the release sleeve reliably on the plug connector housing. Secondly, the latching hook serves for polarization protection, i.e. blocking incorrect mating, and thirdly it furthermore also increases the assembly reliability, since it prevents the incorrect attachment of the release sleeve to the plug connector housing.

Ideally, the release sleeve has, on its guide side, at least one corresponding retaining area in which the latching hook can engage so that reliable retention of the release sleeve on the plug connector housing is ensured. The number of areas required is dependent on the number of latching hooks and therefore likewise arbitrary.

It is particularly advantageous if at least one guide rail is integrally molded on the plug connector housing on both sides of the latching hook, which guide rail further simplifies the insertion of the plug connector housing into the release sleeve for the user. The number of guide rails is arbitrary. Ideally, the release sleeve has, on the associated side, corresponding areas in which the at least one guide rail can engage. This additionally simplifies assembly.

The polarization element can be a substantially cuboidal inner molded portion on the insulating sleeve. In this case, the term "substantially" can be interpreted such that the form of the polarization element, at least in a mating-side end portion, deviates from the cuboidal form in that the polarization element has a conical taper in this end portion, i.e. it tapers conically, i.e. becomes narrower, towards the mating-side end. In this case, this portion can be rounded.

It is therefore particularly advantageous if the polarization element is configured such that it is conically tapered at least in certain areas. The polarization element is advantageously configured such that it is at least conically tapered towards its end. In particular, the conically tapered side, more precisely the conically tapered end, points in the direction of the mating side. This conically tapered end then namely acts similarly to an insertion chamfer and facilitates the mating to the mating plug connector considerably.

The form therefore enables tolerance compensation in certain areas, which facilitates the intermating of the plug connector with, for example, a mating plug connector considerably for a user. Finally, as a result of this form, the plug connector, during its insertion, is pre-aligned in the direction of the mating plug connector from the first mechanical contact of the corresponding housing parts.

The end of the polarization element can be designed to be substantially trapezoidal. However, any other suitable geometric form, for example triangular, round, oval, etc., which results in the polarization element tapering in the mating direction is also conceivable. The form of the polarization element must be selected such that it can cooperate effectively with an accordingly corresponding recess in the mating plug connector and can be easily inserted into the recess by a user, with little effort and without tilting. Moreover, the form of the polarization element is advantageously easy to manufacture.

In a preferred configuration, the polarization element can be inserted into a recess which is arranged on a side of the mating plug connector housing. This recess can be a window in a side wall of the mating plug connector housing, which window is open on the mating side. However, the recess can also consist of a depression. The combination of polarization element and recess particularly advantageously ensures both the optimum mating polarization and the optimum assembly polarization. Incorrect assembly and incorrect mating are thus prevented since the plug connector and the mating plug connector are only intermateable in one alignment.

The polarization element therefore has a dual function. On the one hand, it facilitates correct assembly with the plug connector housing. On the other, it ensures the correct polarization of the assembled plug connector with the mating plug connector.

The plug connector is ideally made from a stable material, in particular metal or plastic. In this case, the constituent parts of the plug connector can be made from the same and/or different materials. The advantage of plastic material is moreover its insulating property, whilst metal advantageously offers good stability and a high load-bearing capacity.

It is advantageous if the plug connector or at least one of its constituent parts is made from plastic, since these parts can then be manufactured cost-effectively and efficiently in an injection molding method. In other words, it is advantageous if the plug connector is made at least partially from injection molded elements. By automating the manufacturing method, production can take place even more cost-effectively and efficiently.

A preferred configuration provides that the plug connector is a so-called "push-pull plug connector". The connection of the polarization element to the push-pull plug connector is particularly advantageous. Such a push-pull plug connector is conventionally notable in that it has a release sleeve, in particular the said release sleeve. For release from a mating plug connector, the respective release sleeve of the plug connector is to be drawn contrary to the mating direction, i.e. away from the mating plug connector, so that both the operation of the release sleeve and the separation of the plug from the mating plug take place in a single movement direction and therefore with a single hand movement. Therefore, the use of conventional polarization elements in the mating procedure is hampered for structural reasons.

The invention here provides a particularly advantageous solution since, according to the invention, the said incorrect assembly and incorrect mating unfortunately occur very often with the push-pull connectors of the prior art.

A preferred system for a plug connection has the plug connector and a mating plug connector. The mating plug connector has two mutually opposing outer sides, of which one corresponds to the guide side and the other to the coding side of the release sleeve, i.e. is brought into mechanical contact therewith during the mating of the plug connector to the mating plug connector. These two mutually opposing outer sides of the mating plug connector differ from one another in terms of their outer contour in that they have different molded portions and/or recesses. The contour of each of these two outer sides is suitable for cooperating with the internal contours of the associated guide or coding side of the release sleeve in the mating procedure and therefore for enabling the mating procedure with the correct polarization and preventing the mating procedure with the incorrect polarization.

In particular, one of the two sides has a polarization recess corresponding to the polarization element or a polarization molded portion corresponding thereto. The polarization recess can be a recess configured to correspond to the form of the polarization element, which is designed to be minimally wider than the polarization element so that this can be advantageously guided therein without tilting or jamming. Alternatively, the polarization molded portion can have, for example, at least one, in particular at least two, parallel extending elevations, which, in the assembled state, are arranged on both sides of the polarization element and guide the release sleeve along its polarization element in the mating direction so that the release sleeve is retained on plug connector housing such that it can be displaced both in and contrary to the mating direction. In this case, the spacing between the two said elevations or the width of this recess can correspond approximately to the width of the polarization element or be somewhat greater than this, i.e. it can exceed the width of the polarization element for example by up to 4%, preferably up to 7%, particularly preferably up to 10%, in particular up to 13% and possibly even up to 16%. The release element can thus be guided along the housing of the mating plug connector, possibly with the "play" required for this, i.e. the mechanical tolerance, and still be fixed in terms of its polarization. This mating contour therefore serves to further increase the mating reliability and the assembly reliability since, as a result, mating is not possible with the wrong polarization. During the mating procedure, the polarization element is guided in this polarization molded portion or in the polarization recess of the mating plug connector. This preferably takes place first, i.e. before the plug connector insert, more precisely the contact elements received therein, and the mating plug connector insert, in particular contact elements received therein, are touching one another or come into mechanical and electrical contact. Incorrect electrical contacting is therefore prevented. This is altogether advantageous due to the orientation during assembly, the orientation during the mating procedure and the different internal configuration of the sides of the release sleeve, which is thus optimally protected.

The invention furthermore relates to a method for assembling a plug connector, in particular the above-mentioned plug connector, which comprises the following steps:

a) inserting the plug connector insert into the plug connector housing,
b) latching the plug connector insert in the plug connector housing,
c) inserting the plug connector housing into the release sleeve with the correct polarization, with cooperation between the contours of the release sleeve and the plug connector housing,
d) latching the plug connector housing in the release sleeve.

These method steps a) to d) ensure quick and easy assembly for the user.

The invention furthermore relates to a method for mating a plug connector previously assembled in the above-mentioned manner to a mating plug connector, which comprises the following steps:

e) inserting the plug connector housing into the housing of the mating plug connector in certain areas,
f) bringing the plug connector housing and the housing of the mating plug connector into mechanical contact first via the release sleeve
g) establishing cooperation between the contours of the release sleeve and the housing of the mating plug connector such that they can slide inside one another and therefore bring the plug connector housing and the housing of the mating plug connector release sleeve together with the correct polarization,
h) latching the release sleeve on the housing of the mating plug connector, and simultaneously
i) latching the plug connector to the mating plug connector by means of at least one latching hook, whilst j) the plug connector housing is simultaneously located in its final relative position with respect to the housing of the mating plug connector, which is intended for the mated state, and k) the plug connector insert is simultaneously located in its final relative position with respect to an insert of the mating plug connector, which is intended for the mated state.

As a result of the method steps e) to k), the intermating of the plug connector and mating plug connector is simplified and incorrect mating with the wrong orientation is prevented.

The invention furthermore relates to a method for separating a previously interlocked plug connector and mating plug connector, which comprises the following steps:

x) releasing the plug connector from the mating plug connector by drawing the release sleeve contrary to the mating direction, y) disengaging the latching mechanism between the plug connector and the mating plug connector, z) separating the plug connector and the mating plug connector.

This method with the steps x) to z) enables quick, reliable separation of the plug connector and mating plug connector for the user. Moreover, the method ensures that the plug connector and mating plug connector cannot be separated from one another unintentionally. This in turn serves to increase user safety.

BRIEF DESCRIPTION OF THE DRAWINGS

An exemplary embodiment of the invention is illustrated in the drawings and will be explained in more detail below. The drawings show.

The figures contain partially simplified schematic illustrations. Identical reference signs are sometimes used for elements which are similar but possible not identical. Different views of similar elements can be drawn to different scales.

DETAILED DESCRIPTION OF THE INVENTION

Figure 1:
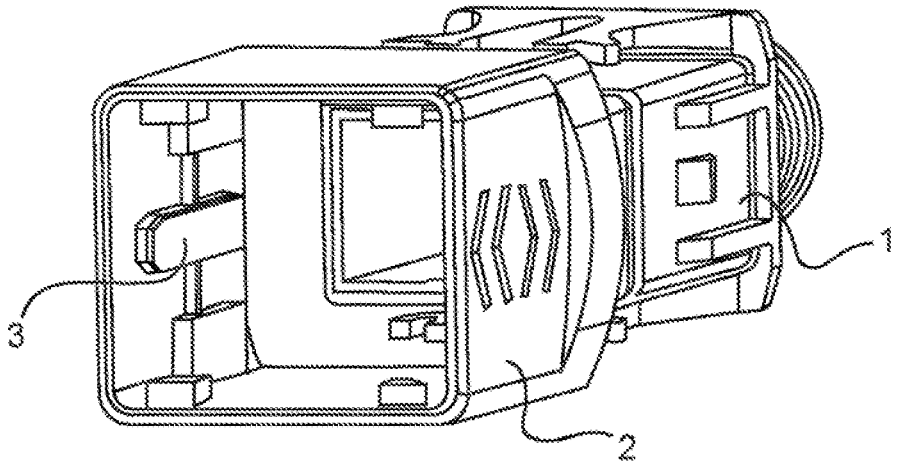
FIG. 1 a perspective illustration of the plug connector housing and release sleeve.

FIG. 1 shows a perspective illustration of a plug connector housing 1 and a release sleeve 2, which are constituent parts of the plug connector. The release sleeve 2 is illustrated at the front in FIG. 1 and the plug connector housing 1 is illustrated at the rear. The release sleeve 2 and the plug connector housing 1 are shown separated from one another in this figure. To ensure the clarity of the figures, the plug connector housing is illustrated without the plug connector inserts in all figures. The plug connector inserts are essentially configured such that they can be received and reliably fastened in the plug connector housing 1. Plug connector inserts for plug connector housings are sufficiently known in a wide variety of embodiments to the person skilled in the art of plug connectors, although their respective configuration is not significant for the function of the plug connector as described in this embodiment.

On the cable connection side, a cable insertion area with a thread of a cable gland is integrally molded on the plug connector housing 1. The mating side is arranged opposite the cable connection side. The plug connector housing 1 has a rectangular cross-section and has four sides arranged orthogonally and/or parallel to one another, namely two wide sides and two narrow sides, which are not denoted by reference signs for reasons of clarity. In this case, the two wide sides and the two narrow sides are parallel opposite one another.

Figure 2:
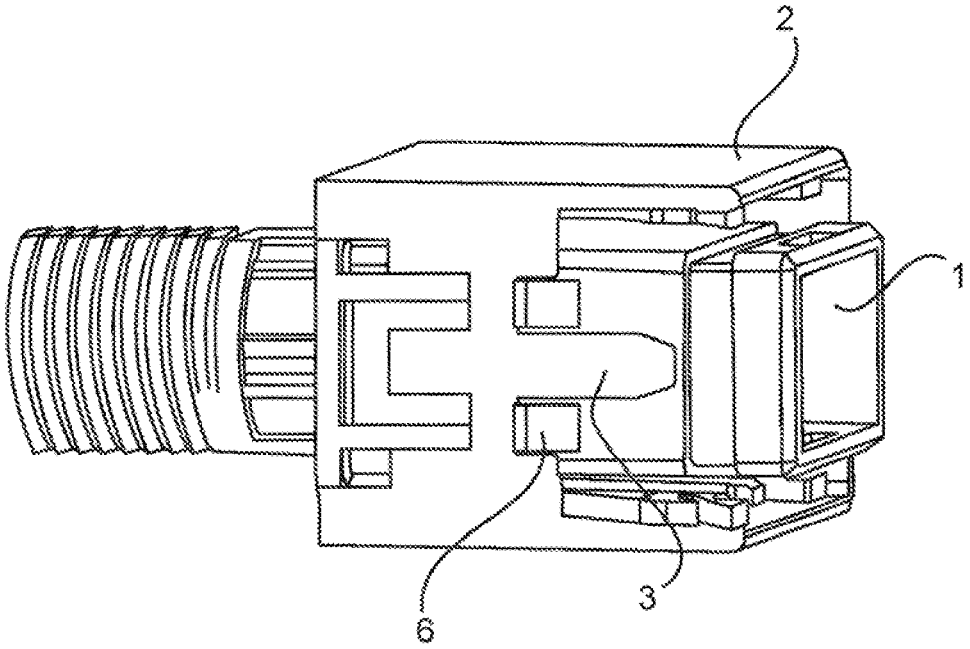
FIG. 2 a sectional illustration through the plug connector housing and release sleeve.

The release sleeve 2 has a rectangular cross-section and therefore four sides arranged orthogonally and/or parallel to one another, namely two narrow and two wide sides, which are parallel opposite one another in each case. The sides walls are not denoted by reference signs for reasons of clarity. However, due to the perspective, only one inner side of these two narrow sides, which will be referred to below as the coding side, is visible in the drawing. The polarization element 3, which is shown more precisely in FIG. 2, is integrally molded internally on the coding side. Parallel opposite the coding side, the release sleeve 2 has the second narrow side, which will be referred to below as the guide side.

FIG. 2 shows the release sleeve 2 and the plug connector housing 1 in a connected state and latched together by means of at least one latching hook 6 in a sectional illustration. The section of this sectional illustration is positioned through the release sleeve 2 and the plug connector housing 1 such that both the above-mentioned latching mechanism and the polarization element 3 can be seen.

The cable connection side of the plug connector housing 1 is illustrated on the left side of the drawing; the associated mating side is arranged correspondingly opposite. The plug connector housing 1 in this exemplary embodiment is retained in the release sleeve 2 by means of two latching hooks 6 on the one side and likewise one latching hook on the associated opposite side, see FIG. 3. In this case, the latching hooks 6 point in the mating direction and prevent unintentional withdrawal of the release sleeve 2 from the plug connector housing 1.

The polarization element 3 is integrally molded centrally on a side of the release sleeve 2. In FIG. 2, the polarization element 3 is positioned centrally between the two latching hooks 6. In the sectional illustration, the polarization element 3 is designed to be conically tapered at least in certain areas, namely towards its end. The form in this example is realized by an elongated rectangle on which an isosceles trapezoid is integrally molded in the direction of the mating side. The narrower side of the two parallel sides is aligned in the direction of the mating side. This form is provided with bevels at the edges in its three-dimensional configuration, so that the insertion of the polarization element 3 into a recess 5 on a mating plug connector 4 is facilitated. This can be seen in FIGS. 4 and 5.

Figure 3:
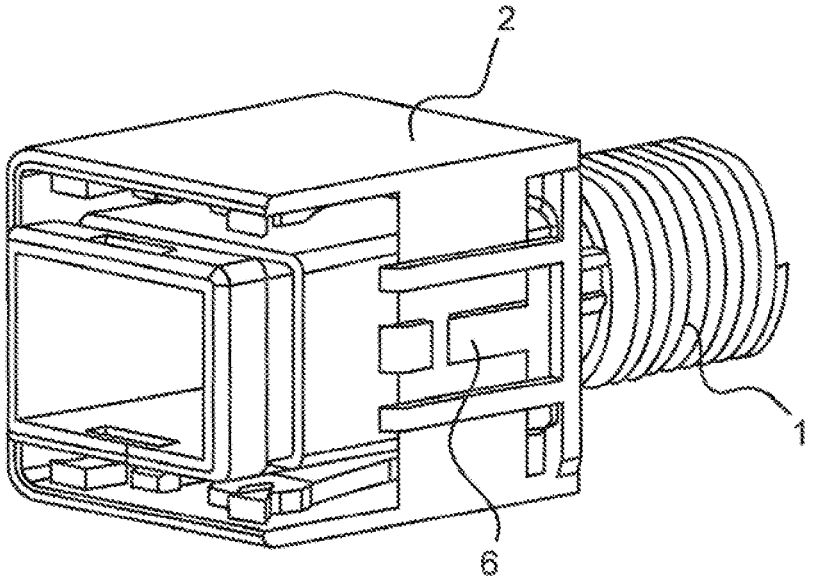
FIG. 3 a sectional illustration through the plug connector housing and release sleeve.

FIG. 3 shows the plug connector in a view which is rotated with respect to the previous illustration, looking onto the previously hidden side in a corresponding sectional illustration.

On the side shown, the plug connector housing 1 has a latching hook 6. This is arranged centrally on the release sleeve 2 and opposite the polarization element 3. The effective direction of the one latching hook 6 on this side is identical to the effective direction of the two latching hooks 6 on the other side. A respective guide rail, which simplifies the insertion of the plug connector housing 1 into the release sleeve 2 for the user, is integrally molded at the side of the latching hook 6 in each case.

FIGS. 2 and 3 show the advantage of the polarization element 3 when assembling the plug connector housing 1 with the release sleeve 2. Incorrect assembly thus prevented.

Figure 4:
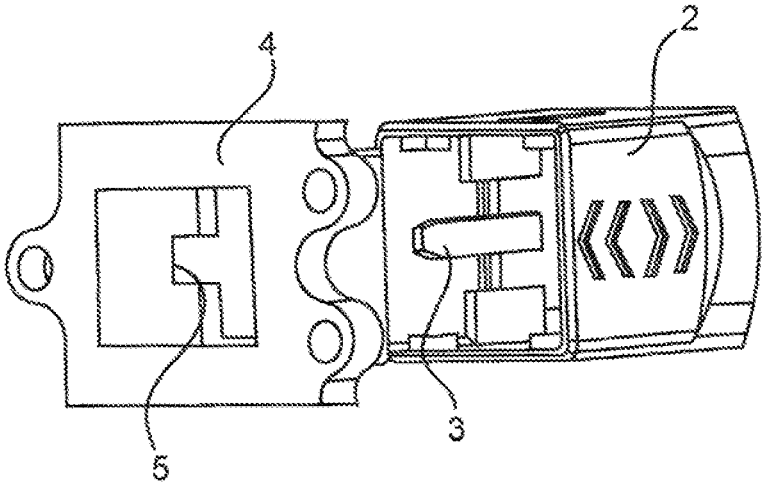
FIG. 4 a perspective illustration of the release sleeve and mating plug connector.

FIG. 4 shows a mating plug connector 4, more precisely a mating plug connector housing, and the release sleeve 2 in a perspective illustration. For the sake of clarity, the two elements are shown separated in this figure. They are shown intermated in FIG. 5. In this case, the release sleeve 2 corresponds to the release sleeve 2 shown in FIGS. 1 to 3.

Figure 5:
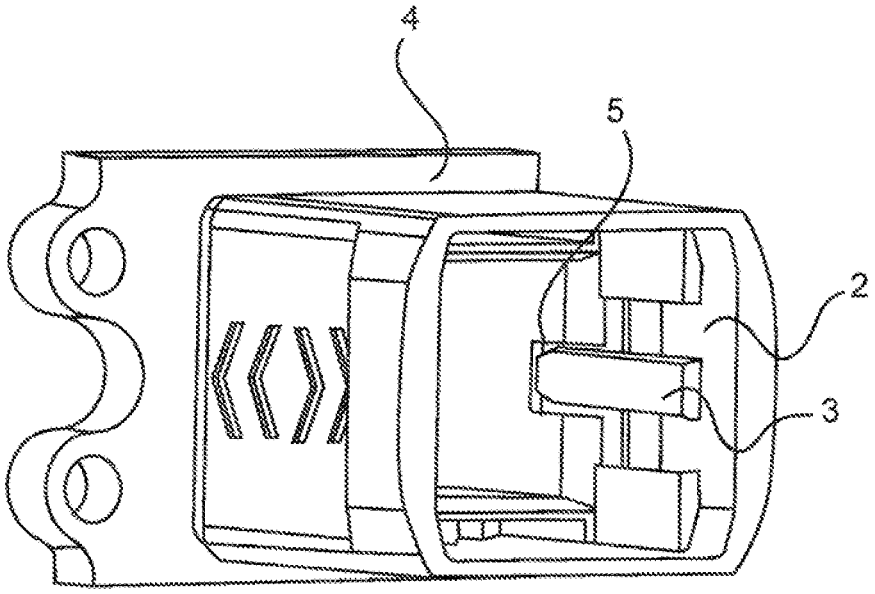
FIG. 5 a perspective illustration of the release sleeve and mating plug connector.

The mating plug connector 4 is shown, in each case, without a plug connector insert in FIGS. 4 and 5. The plug connector inserts are therefore configured such that they can be received and reliably fastened in the housing of the mating plug connector 4. Plug connector inserts for plug connector housings and corresponding mating plug connector housings are sufficiently known in the prior art. By way of example, the housing of the mating plug connector 4 which is shown is an attachment housing for assembling on the wall of a device, an installation or the like. Instead of an attachment housing, the housing of the mating plug connector 4 can also be a socket housing or a feed-through housing or a support sleeve. The said housing types are sufficiently known in the prior art. The housing of the mating plug connector 4 has to be selected so that it corresponds to the plug connector housing.

The housing of the mating plug connector 4 has, on one side, a recess 5 into which the polarization element 3 of the release sleeve 2 engages and with which it cooperates. The recess 5 is a rectangular cutout in the wall of the housing of the mating plug connector 4.

In FIG. 5, likewise a perspective illustration, the elements which are still separated in FIG. 4, the housing of the mating plug connector 4 and the release sleeve 2, are intermated. It can be seen in this figure how the recess 5 and the polarization element 3 cooperate. This cooperation defines the correct mating. Incorrect mating of the plug connector and the mating plug connector 4 is thus prevented.

Even where combinations of various aspects or features of the invention are shown in combination in the figures in each case, it is clear to the person skilled in the art—unless indicated otherwise—that the combinations shown and discussed are not the only possible combinations. In particular, mutually corresponding units or feature complexes from different exemplary embodiments can be interchanged with one another.

LIST OF REFERENCE SIGNS

1 Plug connector housing
2 Release sleeve
3 Polarization element
4 Mating plug connector
5 Recess
6 Latching hook

The invention claimed is:

1. A plug connector, which can be latched to a mating plug connector, having a plug connector housing with a plurality of sides which each have a planar form, a plug connector insert, which is fastened, or at least can be fastened, in the plug connector housing, and a release sleeve, which reaches around the plug connector housing and is retained on the plug connector housing such that it can be displaced contrary to the mating direction for releasing the plug connector from the mating plug connector, wherein the release sleeve has at least one polarization element configured to cooperate with both the plug connector housing and the mating plug connector in a polarizing manner, and wherein the polarization element is configured to be inserted into a recess which is arranged on one side of the mating plug connector housing.

2. The plug connector as claimed in claim 1, wherein the at least one polarization element is arranged internally on the release sleeve.

3. The plug connector as claimed in claim 1, wherein the polarization element is a substantially cuboidal molded portion on the locking sleeve.

4. The plug connector as claimed in claim 1, wherein the polarization element is conically tapered, at least in certain areas.

5. The plug connector as claimed in claim 1, wherein the polarization element has a mating-side end portion with a conical taper.

6. The plug connector as claimed in claim 1, wherein the plug connector is a push-pull plug connector.

7. A system comprising a plug connector as claimed in claim 1 and a mating plug connector.

8. The system as claimed in claim 7, wherein the mating plug connector has a mating plug connector housing with two mutually opposing outer sides, which differ from one another in terms of their respective external contours and cooperate with the contours of the release sleeve in a polarizing manner.

9. A method for assembling a plug connector as claimed in claim 1, which comprises the following steps:

a) inserting the plug connector insert into the plug connector housing, b) latching the plug connector insert in the plug connector housing, c) inserting the plug connector housing into the release sleeve with the correct polarization, with cooperation between the contours of the release sleeve and the plug connector housing, and d) latching the plug connector housing in the release sleeve.

10. A method for mating a plug connector of a plug connector previously assembled according to claim 9 to a mating plug connector, which comprises the following steps:

e) inserting the plug connector housing into a housing of the mating plug connector in certain areas, f) bringing the plug connector housing and the housing of the mating plug connector into mechanical contact first via the release sleeve, g) establishing cooperation between the polarization element of the release sleeve and the housing of the mating plug connector such that they can slide inside one another and therefore bring the plug connector housing and the housing of the mating plug connector together with the correct polarization, h) latching the release sleeve on the housing of the mating plug connector, and simultaneously i) latching the plug connector to the mating plug connector using at least one latching hook, whilst j) the plug connector housing is simultaneously located in its final relative position with respect to the housing of the mating plug connector, which is intended for the mated state, and k) the plug connector insert is simultaneously located in its final relative position with respect to an insert of the mating plug connector, which is intended for the mated state.

11. A method for separating a plug connector from a mating plug connector, which were previously mated according to claim 10, which comprises the following steps:

a) releasing the plug connector from the mating plug connector by drawing the release sleeve contrary to the mating direction, b) disengaging the latching mechanism between the plug connector and the mating plug connector, and c) separating the plug connector and the mating plug connector.

12. The plug connector as claimed in claim 2, wherein the polarization element is a substantially cuboidal molded portion on the locking sleeve.

13. The plug connector as claimed in claim 2, wherein the polarization element is conically tapered, at least in certain areas.

14. The plug connector as claimed in claim 2, wherein the polarization element has a mating-side end portion with a conical taper.

15. The plug connector as claimed in claim 2, wherein the plug connector is a push-pull plug connector.

16. A system comprising a plug connector as claimed in claim 2 and a mating plug connector.

17. The system as claimed in claim 16, wherein the mating plug connector has a mating plug connector housing with two mutually opposing outer sides, which differ from one another in terms of their respective external contours and cooperate with the contours of the release sleeve in a polarizing manner.

* * * * *